US007658054B2

(12) United States Patent
Veix

(10) Patent No.: US 7,658,054 B2
(45) Date of Patent: Feb. 9, 2010

(54) CARTONER MACHINE AND A METHOD OF OPERATING SAME

(75) Inventor: Scott Veix, Bradenton, FL (US)

(73) Assignee: KHS AG, Dortmund (DE)

( * ) Notice: Subject to any disclaimer, the term of this patent is extended or adjusted under 35 U.S.C. 154(b) by 47 days.

(21) Appl. No.: 11/936,845

(22) Filed: Nov. 8, 2007

(65) Prior Publication Data

US 2009/0124477 A1 May 14, 2009

(51) Int. Cl.
*B65B 3/02* (2006.01)

(52) U.S. Cl. ..... 53/458; 53/381.1; 53/382.1; 53/564

(58) Field of Classification Search ..... 53/457, 53/458, 452, 381.1, 382.1, 558, 564
See application file for complete search history.

(56) References Cited

U.S. PATENT DOCUMENTS 2,643,497 A * 6/1953 Woelfer ..... 53/564
2,924,156 A * 2/1960 Lloyd ..... 493/124
3,509,681 A * 5/1970 Sass ..... 53/473
5,456,381 A * 10/1995 Fochler ..... 221/197
6,381,927 B1 * 5/2002 Moncrief et al. ..... 53/457
6,474,635 B2 * 11/2002 Ruf et al. ..... 271/12
7,329,218 B2 * 2/2008 Kisch ..... 493/309

* cited by examiner

*Primary Examiner*—Christopher Harmon
(74) *Attorney, Agent, or Firm*—Nils H. Ljungman & Associates

(57) ABSTRACT

Cartoner machine and a method of operating same. The abstract of the disclosure is submitted herewith as required by 37 C.F.R. §1.72(b). As stated in 37 C.F.R. §1.72(b): A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims. Therefore, any statements made relating to the abstract are not intended to limit the claims in any manner and should not be interpreted as limiting the claims in any manner.

18 Claims, 6 Drawing Sheets

CARTONER MACHINE AND A METHOD OF OPERATING SAME

BACKGROUND

One of the main components of a cartoning machine is a cartoner assembly which contains several components that transport a supply of flat, folded cartons and then open them for product insertion. The folded cartons in a cartoner assembly are located on a guide conveyor that moves the cartons forward by means of a motorized belt. The motorized belt transports the folded cartons forward into a face plate. The face plate guides the folded cartons into a desired position for future transportation. In addition, the face plate will hold the folded cartons in this position until a grabbing device to transport the folded cartons reaches the face plate. Once the folded cartons are removed from the face plate with a grabbing device, the folded cartons are moved to a separate conveyor where they are opened for product insertion.

Many current face plate assemblies incorporate static face plates that are designed and constructed around a single specific box size. Each face plate has to be designed, built, assembled, and delivered before starting production. This is a problem because production for a company can be put on hold until the face plate for a specific box size is completed, thus last minute changes to a box size can cause lengthy delays.

Existing face plate assemblies are also extremely limited in the range of box sizes that can be fed into them. In addition, these types of face plates often only allow slight adjustments to obtain optimum feeding of the carton size that the face plates are designed around. This leads to the purchase of numerous face plates because most companies utilize more than one type of box for packaging their goods. The greater the variety of boxes a company uses, the more face plates are needed. For example, a company may have up to 200 face plates because of the variety of boxes that the company uses. In addition to the expense of purchasing many face plates, the face plates take up a significant amount of storage space, which can also be a problem. For example, an entire room of a factory could be dedicated solely to the storage of face plates. In addition, the stored face plates could suffer damage over time or even become outdated if the box size a particular face plate holds is modified or never used again. Further, if the cartoner machine is upgraded, it may be unable to utilize older face plates. Such situations would lead to a loss of the investment in a particular face plate or an entire series of face plates.

Current face plate designs can also lead to a loss of efficiency in that the retrieval and changing of face plates takes time to perform. Once a new box size is required on the cartoner system, a worker must remove the installed face plate from the carton delivery system. The worker then will have to relocate the removed face plate to a supply room, retrieve the necessary face plate for the new box size, and return to the cartoner assembly to install the new face plate. Only after the new face plate is installed can the cartoner assembly feed a new carton size into the carton delivery system.

SUMMARY

An adjustable face plate according to at least one possible embodiment permits the use of a method of increasing the productivity of a cartoner during short runs of 300 to 1500 different box sizes. Instead of a static face plate with a minimal adjustment capacity for a particular box size, the adjustable face plate is fully adjustable to a wide variety of box sizes. The size range for the adjustable face plate design, in at least one possible embodiment, is a carton length between 2.0" and 13.5", a carton width between 0.63" and 6.0", and a carton depth between 3.25" and 13". In another possible embodiment, the adjustable face plate could be designed to handle boxes, cartons, or containers of greater or lesser length, width, and depth dimensions. The adjustable face plate is designed to adjust to a desired box size, so there is no waiting period for a face plate to be designed, built, assembled, and installed or found and installed.

In addition to the convenience of adjustments, the adjustable face plate design enables users to note the exact points of adjustment to the face plate. There are scales on the adjustable face plate that users can use as reference points for various carton sizes. When a carton comes through the cartoner machine that was also used three months before, the user would only have to refer to the adjustments made for that same box three months before by using the scales on the face plate as a reference. In addition, when box sizes are similar to one another, the scale references could be used to form a starting point of adjustment.

With the adjustable face plate design, only one face plate is needed for each cartoner, thus freeing up storage space and saving money. Co-packers, or customers who often change the size of their cartons, would have a great advantage with the adjustable face plate. Currently, co-packers can use up to 1500 different carton sizes to package their products. Snack manufacturers, for example, can use 150 different types of candy boxes, or cartons, and display cartons. The adjustable face plate facilitates an easy transition from one box size to another in that there is no need to retrieve a new face plate, but instead the worker only needs to adjust the face plate adjustments to the desired position for the new box size, thus increasing productivity and efficiency.

The above-discussed embodiments of the present invention will be described further hereinbelow. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

DESCRIPTION OF EMBODIMENT OR EMBODIMENTS

Figure 1:
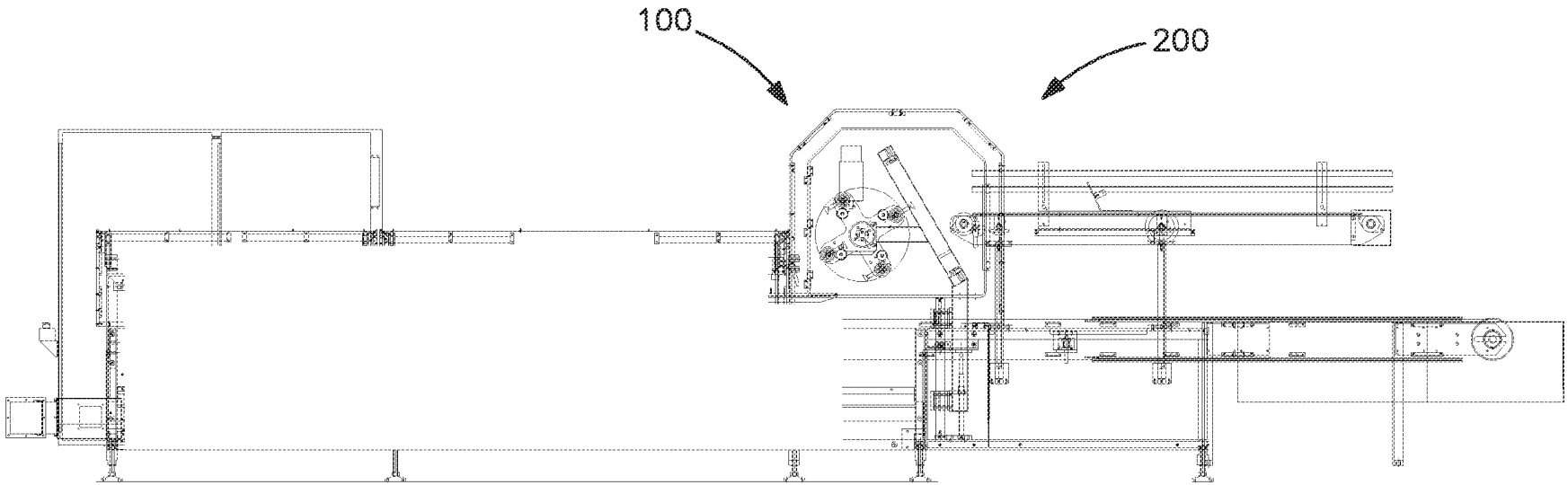
FIG. 1 shows an example of a cartoner machine having a cartoner assembly.

FIG. 1 shows for exemplary purposes a cartoner assembly 100 as part of a cartoning machine 200. It should be noted that portions of the cartoning machine 200 have been omitted for simplicity. Examples of such a cartoning machine are the CMC/Sm Continuous Motion Cartoner and the IMC/Sm Intermittent Motion Cartoner manufactured by KHS USA Inc., headquartered at 880 Bahcall Ct., P.O. Box 1508, Waukesha, Wis., 53187, which company is part of KHS AG, headquartered in Dortmund, Germany. Information on the CMC/Sm Continuous Motion Cartoner may be found in brochure no. 1323, entitled "CMC/Sm Formula 2000 Series—Cartoning Machines", and information on the IMC/Sm Intermittent Motion Cartoner may be found in brochure no. 1324, entitled "IMC/Sm Formula 2000 Series—Cartoning Machines", both of which brochures are published by KHS USA Inc.

Figure 2:
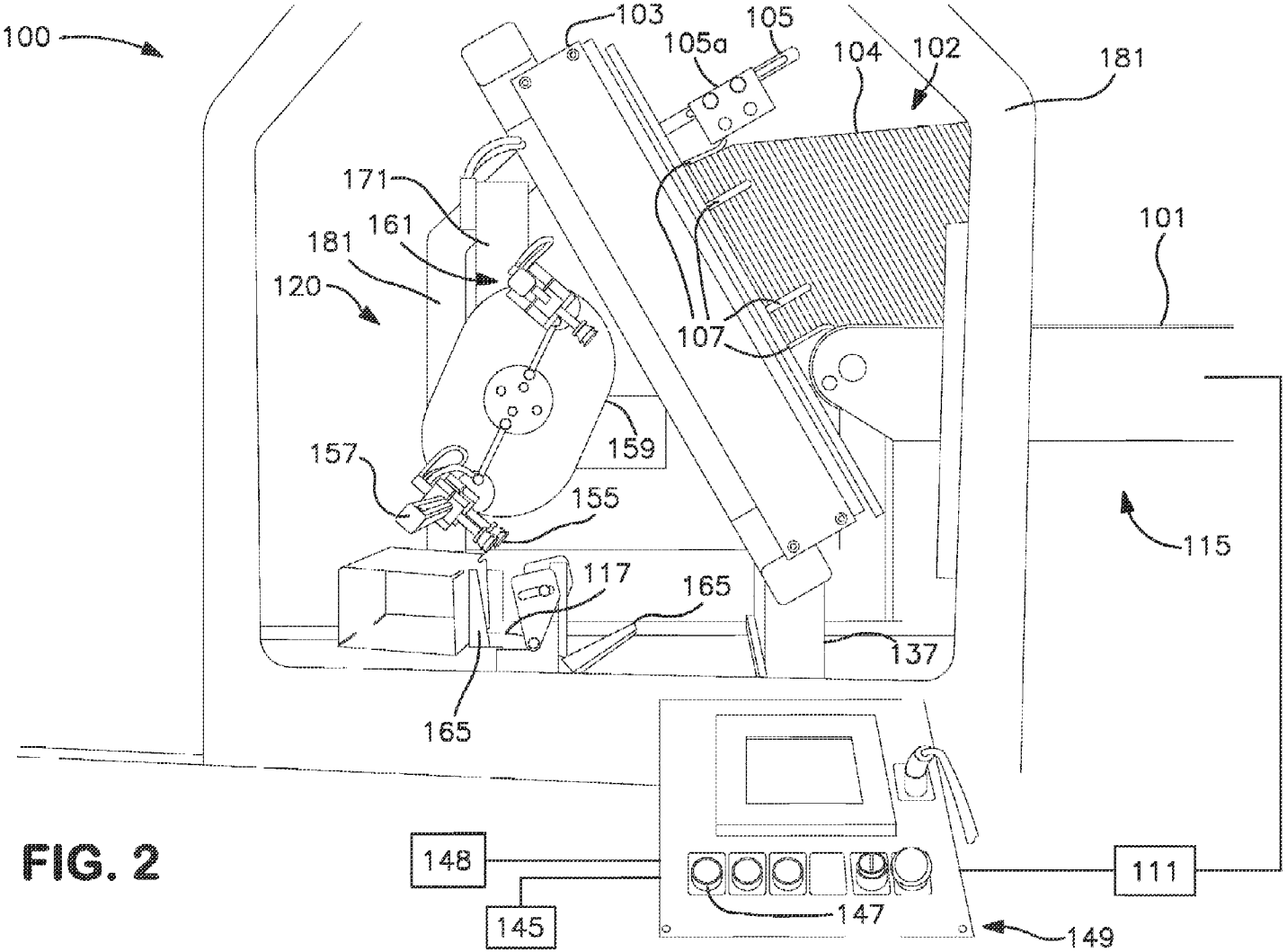
FIG. 2 shows a side view of an adjustable cartoner assembly.

FIG. 2 shows a cartoner assembly 100 for receiving a supply of flat, folded cartons 104 and then opening the folded cartons 104 to form open cartons or boxes for insertion of a product therein. In at least one possible embodiment, the cartoner assembly 100 can be an intermittent cartoner. In another possible embodiment, the cartoner assembly 100 can be a continuous motion cartoner. The folded cartons 104 are fed from a carton magazine or carton supply 102. A portion of the folded cartons 104 are supported on a motorized belt 101 of a guide conveyor 115, which is driven by a belt drive motor 111. The guide conveyor 115 is operatively connected to the cartoner frame 181. The motorized belt 101 moves the folded cartons 104 forward to an adjustable face plate or adjustable carton guide 103.

While the adjustable face plate 103 holds and guides a portion of the folded cartons 104 that have been moved forward on the motorized belt 101, the carton supply 102 continues to feed folded cartons 104 on the motorized belt 101 toward the face plate 103. In at least one possible embodiment, the folded cartons 104 are moved forward intermittently as the supply fed to the face plate 103 is depleted. To control the intermittent operation of the belt drive motor 111 and the motorized belt 101, a sensor 105*a* is mounted on the face plate 103 via a sensor mount 105. In at least one possible embodiment, the sensor 105*a* can be a photoelectric sensor. The sensor 105*a* is positioned and designed to sense and monitor the supply of folded cartons 104 on the guide conveyor 115. During operation of the cartoner assembly 100, the folded cartons 104 are removed from the face plate 103, thereby depleting the number of folded cartons 104 in the carton supply 102. When the sensor 105*a* senses that there is a shortage of cartons or a low carton supply in the carton supply 102 on the motorized belt 101, the sensor 105*a* sends a signal to the belt drive motor 111 to actuate the belt drive motor 111, and thus feed more folded cartons 104 into the face plate 103. Once a desired or appropriate supply or number of folded cartons 104 is reestablished, the sensor 105*a* sends a signal to the belt drive motor 111 to stop the belt drive motor 111 and terminate the forward movement of the motorized belt 101.

As shown in FIG. 2, the motorized belt 101 transports the folded cartons 104 in a manner substantially parallel to the ground toward the face plate 103. As the folded cartons 104 approach the face plate 103, the folded cartons 104 begin a substantially downward descent as they travel off of the motorized belt 101 and onto guide rods 107 of the face plate 103. The folded cartons 104 are then moved forward toward the face plate 103 by means of force generated by the motorized belt 101, as well as pressure from the weight of the folded cartons 104 in the carton supply 102. As the folded cartons 104 move in a substantially downward direction, guide rods 107 on the face plate 103 assist in the positioning of the folded cartons 104 as they enter the face plate 103. Once the folded cartons 104 are within the face plate 103, stop tabs 133 located at the ends 108 of the guide rods 107 prevent the folded cartons 104 from moving any further forward.

Figure 3:
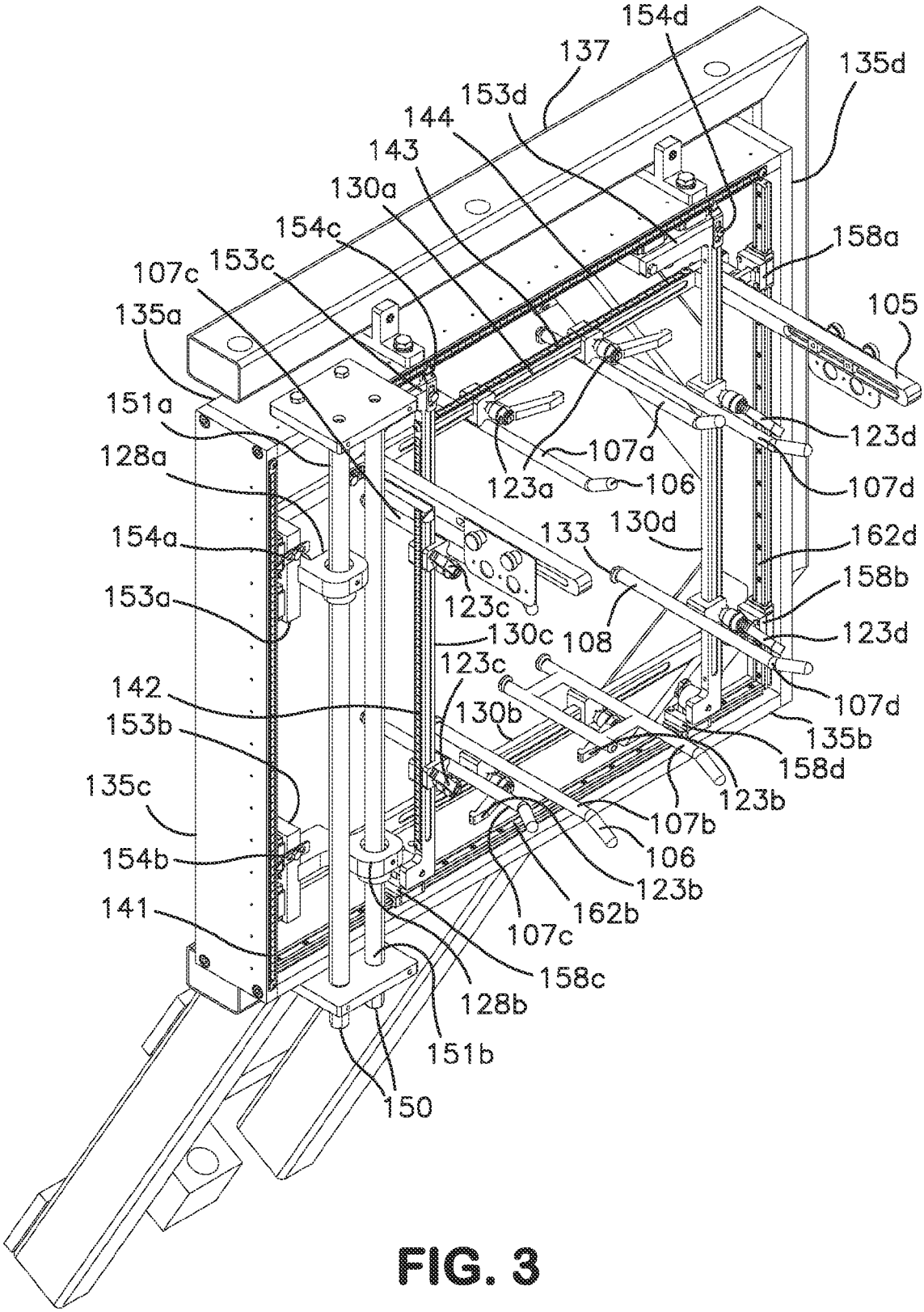
FIG. 3 shows a perspective view of an adjustable face plate.

In FIG. 3, the adjustable face plate 103 is mounted in a frame 137. The face plate 103 has mounting panels 135*a*, 135*b*, 135*c*, and 135*d*. The mounting panels 135*a* and 135*b* are substantially parallel to one another. The mounting panels 135*c* and 135*d* are substantially parallel to one another and are substantially perpendicular to mounting panels 135*a* and 135*b*. The mounting panels 135*a* and 135*b* are substantially parallel to the ground, and mounting panel 135*b* is substantially closer to the ground than mounting panel 135*a*. The mounting panels 135*a* and 135*b* are at least somewhat longer than mounting panels 135*c* and 135*d*, thus forming a substantially rectangular shape. Guide rod mounts 130*a*, 130*b*, 130*c*, and 130*d* correspond to mounting panels 135*a-d*. More specifically, guide rod mount 130*a* is at the top of the face plate 103, substantially parallel to mounting panel 135*a*, and substantially closer to mounting panel 135*a* than mounting panel 135*b*. Guide rod mount 130*b* is at the bottom of the face plate 103, substantially parallel to mounting panel 135*b*, and substantially closer to mounting panel 135*b* than mounting panel 135*a*. Guide rod mount 130*c* is located on one side of the face plate 103, substantially parallel to mounting panel 135*c*, and substantially closer to mounting panel 135*c* than mounting panel 135*d*. Guide rod mount 130*d* is located on one side of the face plate 103, substantially parallel to mounting panel 135*d*, and substantially closer to mounting panel 135*d* than mounting panel 135*c*. Guide rod mounts 130*a* and 130*b* are at least somewhat longer than guide rod mounts 130*c* and 130*d*.

Guide rods 107*a*, 107*b*, 107*c*, and 107*d* are elongated members with slightly angled or bent or curved ends 106 nearest to the carton supply 102, and are used to aid in the guidance of the folded cartons 104 as they enter the face plate 103. Each one of the guide rods 107*a-d* has it's own guide lock 123*a*, 123*b*, 123*c*, and 123*d*, so that the guide rods 107*a-d* can be located as required along the guide rod mounts 130*a-d*. Guide rods 107*a* are mounted on the top guide rod mount 130*a*, guide rods 107*b* are mounted on the bottom guide rod mount 130*b*, guide rods 107*c* are mounted on the side guide rod mount 130*c*, and guide rods 107*d* are mounted on the side guide rod mount 130*d*. The guide rods 107*a-d* are attached to the guide rod mounts 130*a-d* at a central portion of the guide rods 107*a-d* such that the guide rods 107*a-d* project outwardly in both directions away from the guide rod mounts 130*a-d*. The guide rods 107*a-d* guide and position the folded cartons 104 that are moving into the face plate 103. The folded cartons 104 are finally prevented from moving any further forward when they encounter stop tabs 133 at guide rod ends 108. As shown in FIG. 3, one of the guide rods 107*b* has two rod portions with two stop tabs 133 to form a type of double guide rod in order to provide extra support for the folded cartons 104 supported thereon. In another possible embodiment, each of the guide rods 107*b* could have only one guide rod or each could have two guide rods, depending on the type of support desired.

Figure 3A:
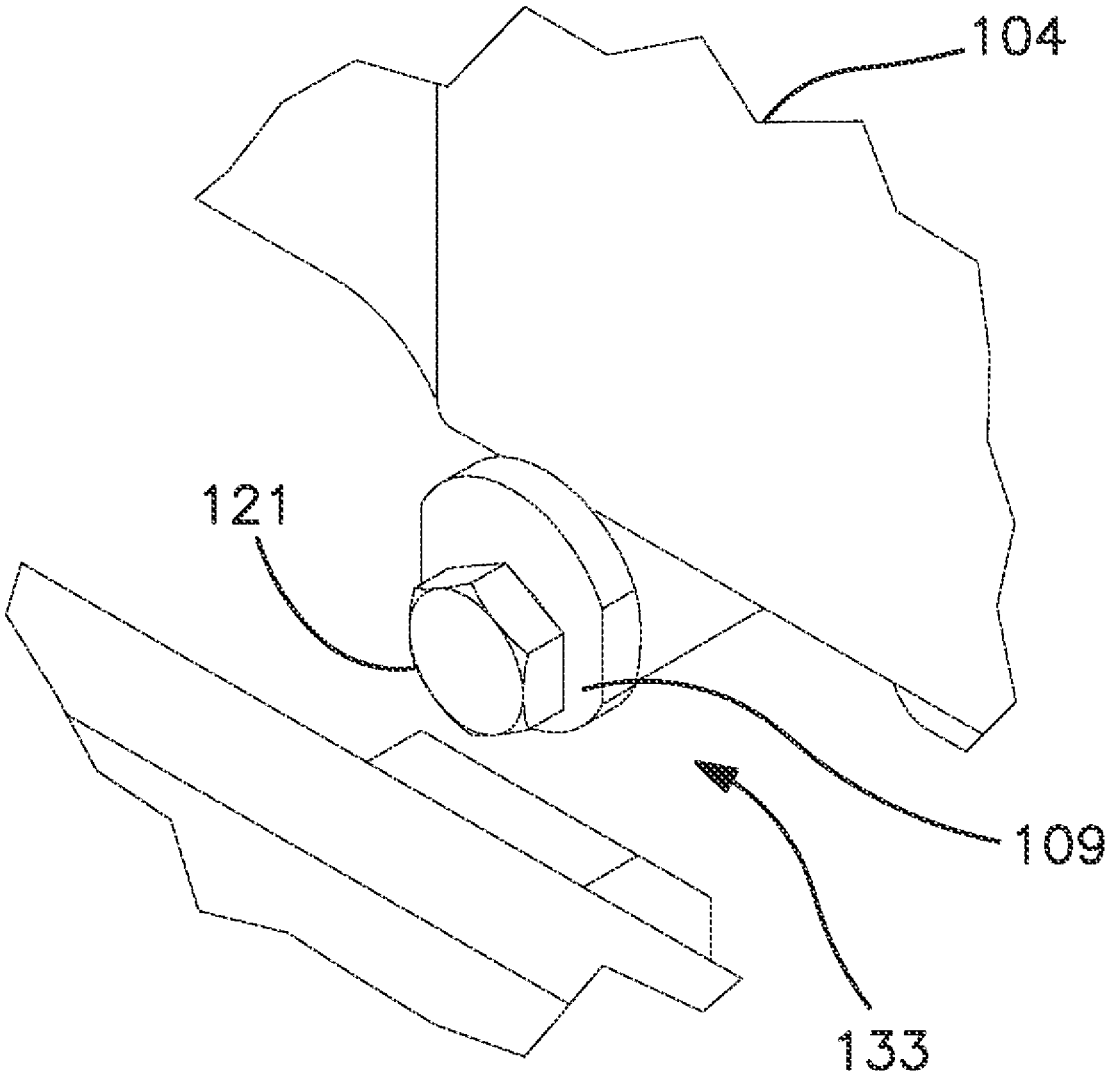
FIG. 3A shows a close view of stop tabs on guide rods.

The stop tabs 133, shown in FIG. 3A, hold the folded cartons 104 in place until they are removed from the face plate 103. A seen in FIG. 2, a rotary feeder apparatus 120 grabs the individual folded cartons 104 out of the face plate 103 and places the individual folded cartons 104 on a lower conveyor belt 117. There are vacuum cups 155 on the rotary feeder apparatus 120 that overcome the retaining force of the stop tabs 133 and thereby remove the folded cartons 104 from the face plate 103. If the folded cartons 104 held in position by the stop tabs 133 are not retained as desired in the face plate 103, the stop tabs 133 may be adjusted to increase or decrease the overlap of the stop tabs 133 with the cartons 104.

The stop tabs 133 include eccentric retainer clips 109 and lock bolts 121 (as seen in FIG. 3A). The eccentric retainer clips 109 are held in place on the ends 108 of the guide rods 107*a-d* by the lock bolt 121. To adjust the stop tabs 133, the lock bolts 121 can be individually loosened, and the stop tabs 133 can then be rotated to increase or decrease the amount of overlap the stop tabs 133 have on the folded cartons 104. After the adjustment is made, the lock bolts 121 may be tightened to hold the stop tabs 133 in their new positions.

Figure 4:
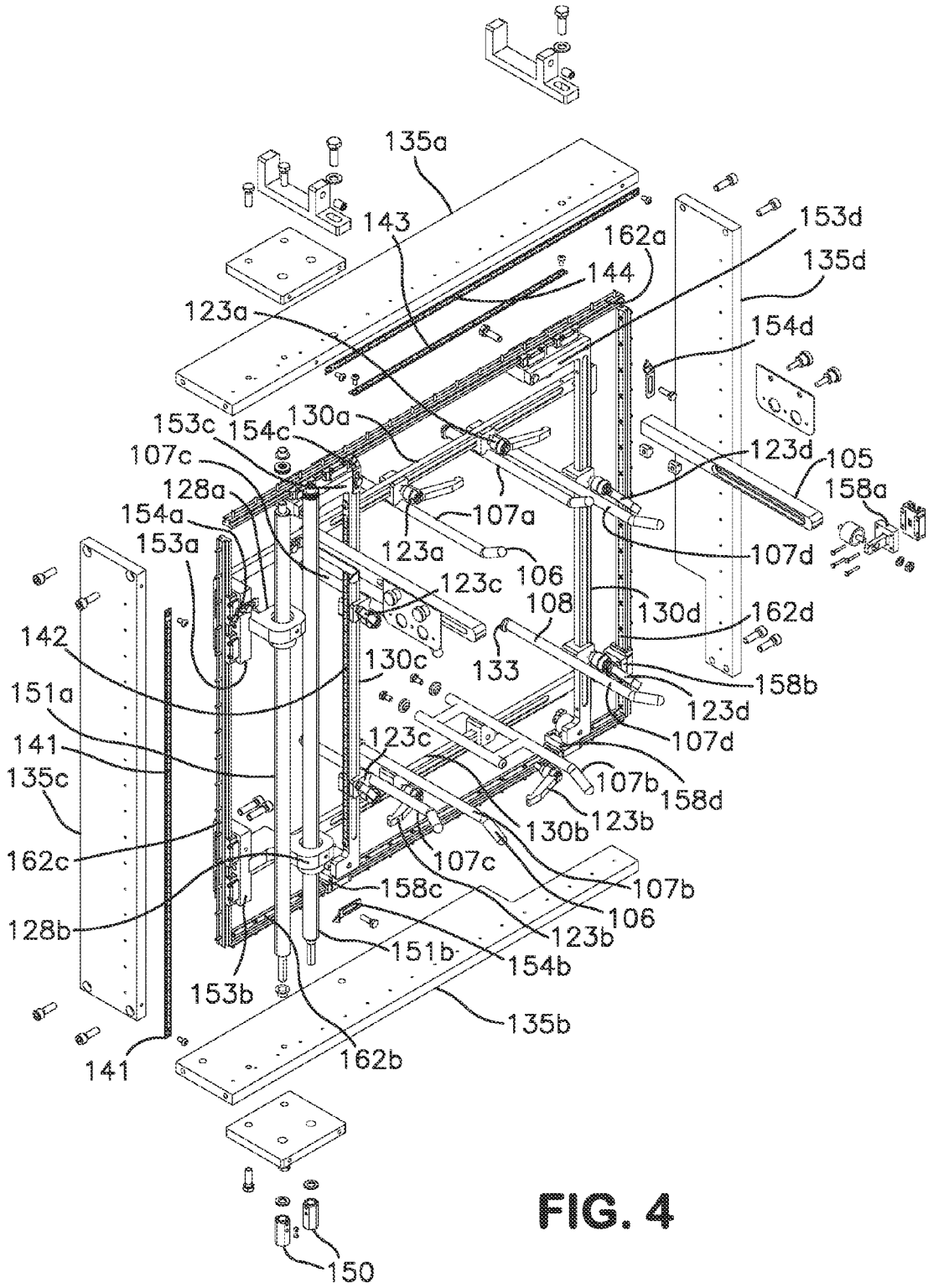
FIG. 4 shows an exploded view of the adjustable face plate according to FIG. 3.

Referring to FIGS. 3 and 4, the adjustable face plate 103 is designed to be adjusted to permit the handling of different-sized cartons. Specifically, the location and spacing of the guide rods 107*a-d* can be changed according to the size of the folded cartons 104. In the embodiment shown in FIGS. 3 and 4, a pair of guide rods 107*a-d* are mounted on each of the guide rod mounts 130*a-d* using guide locks 123*a-d*, although more or fewer guide rods 107*a-d* could be utilized as desired in other embodiments. The guide locks 123*a-d* have quick release handles that enable a user to release the guide locks 123*a-d* and physically slide the guide rods 107*a-d* into a desired location on the guide rod mounts 130*a-d*.

In order to physically adjust the vertical spacing between the guide rods 107*a* and 107*b* on the guide rod mounts 130*a* and 130*b*, respectively, there is a separate adjustment using an adjustment arrangement. To further explain, there are threaded adjustment screws 151*a* and 151*b* adjacent the side guide rod mount 130*c*. The adjustment screws 151*a-b* are vertical shafts that span the height of the face plate 103. There is one threaded adjustable holding mechanism 128*a* and 128*b* on each of the adjustment screws 151*a-b*. The adjustable holding mechanism 128*a* is located towards the top of the adjustment screw 151*a*. Additionally, the adjustable holding mechanism 128*b* is located towards the bottom of the adjustment screw 151*b*. The holding mechanisms 128*a-b* on the adjustment screws 151*a-b* connect to adjustment slides 153*a* and 153*b* on the side of the adjustable magazine face plate 103 adjacent the side guide rod mount 130*c*. The adjustment slide 153*a* connects the horizontal guide rod mount 130*a* to the adjustable holding mechanism 128*a*, and the adjustment slide 153*b* connects the horizontal guide rod mount 130*b* to the adjustable holding mechanism 128*b*. At the bottom of the adjustment screws 151*a-b*, there are hex knobs 150. When one of the hex knobs 150 is rotated, its corresponding adjustment screw 151*a* and 151*b* is rotated. When the threaded adjustment screws 151*a-b* are rotated, the corresponding holding mechanisms 128*a-b* are also moved up or down, thereby moving the corresponding adjustment slides 153*a-b* up or down. By moving the adjustment slides 153*a* and 153*b*, the horizontal guide rod mounts 130*a* and 130*b* can be moved to adjust the spacing between the guide rods 107*a* and 107*b*. As shown in FIG. 4, the adjustment slides 153*a-b* slide on a slide rail 162*c* which is connected by pins to mounting panel 135*c*. In addition, connected to the ends of the guide rod mounts 130*a-b* opposite the adjustment slides 153*a-b* are corresponding slide supports 158*a* and 158*b*. The slide supports 158*a-b* are disposed to slide on a slide rail 162*d*, which is connected by pins to the mounting panel 135*d*.

As shown in FIG. 3, the adjustment slides 153*a-b* are positioned using a gauge or scale 141 as a reference point, which scale 141 is mounted on an edge of the mounting panel 135*c* beside the adjustment slides 153*a-b*. Each of the adjustment slides 153*a* and 153*b* have a pointer or marker structure 154*a* and 154*b*, respectively, such as a triangular tab, that points to the scale 141 to indicate the position of the adjustment slides 153*a-b* with respect to the scale 141. In the adjustment process, if a user wants to adjust the vertical spacing of the guide rod mounts 130*a-b*, and thus the spacing between the guide rods 107*a-b* mounted thereon, to handle a particular carton size, the user would turn the hex knobs 150 until the marker structures 154*a-b* of the adjustment slides 153*a-b* are each lined up with a desired position on the scale 141 that corresponds to the carton size.

Similarly to the guide rod mounts 130*a-b*, the guide rod mounts 130*c-d* can also be moved to adjust the spacing there between using an adjustment arrangement. The guide rod mount 130*c* is connected to an adjustment slide 153*c* and the guide rod mount 130*d* is connected to an adjustment slide 153*d*. The adjustment slides 153*c-d* slide on a slide rail 162*a*, which is connected by pins to mounting panel 135*a*. Connected to the ends of the guide rod mounts 130*c-d* opposite the adjustment slides 153*c-d* are corresponding slide supports 158*c* and 158*d*. The slide supports 158*c-d* are disposed to slide on a slide rail 162*b*, which is connected by pins to the mounting panel 135*b*. In the embodiment shown in FIG. 3, the guide rod mounts 130*c-d* can be manually moved substantially horizontally to adjust the spacing there between and thus the spacing between the guide rods 107*c-d*. In one possible embodiment, the slide supports 158*c-d* could have locking mechanisms that could be manually locked to retain the slide supports 158*c-d* on the slide rail 162*b*, and thus the guide rod mounts 130*c-d*, in a particular position before or after an adjustment. In another possible embodiment, the adjustment slides 153*c-d* could be connected to an adjustment arrangement which utilizes hex knobs, adjustment screws, and adjustable holding mechanisms, such as is shown in FIG. 3 to adjust the spacing of the guide rod mounts 130*a-b*. In addition, there is also a scale or gauge 144 mounted on an edge of the mounting panel 135*a*, which scale 144 is utilized in a similar manner as the scale 141 as a reference in the adjustment of the horizontal spacing between guide rod mounts 130*c-d* and their corresponding guide rods 107*c-d*. Each of the adjustment slides 153*c-d* have a pointer or marker structure 154*c* and 154*d*, respectively, such as a triangular tab, that points to the scale 144 to indicate the position of the adjustment slides 153*c-d* with respect to the scale 144.

In addition to the scales 141 and 144, there are two more scales 142 and 143 shown in FIG. 3 on the guide rod mounts 130*c* and 130*a*, respectively. These scales 142, 143 are utilized to position the guide locks 123*c* and 123*a*, respectively, and their corresponding guide rods 107*c* and 107*a* on their guide rod mounts 130*c* and 130*a*. In at least one possible embodiment, the guide locks 123*a* and 123*c* could have scratch marks or notches thereon to assist in aligning the guide locks 123*a* and 123*c* at a desired position with respect to the scales 143 and 142, or they could have markers attached thereto similar to the markers 154*a-d*. Although not visible in FIG. 3, guide rod mounts 130*b* and 130*d* have scales thereon for the adjustment and positioning of the guide rods 107*b* and 107*d*. In at least one possible embodiment, the scales on the guide rod mounts 130*a-d* could be omitted or possibly placed on only one, two, or three of the guide rod mounts 130*a-d* as desired.

Referring to FIG. 2, if the folded cartons 104 are misaligned or fail to slide as desired on the guide rods 107*a-d*, a vibration unit 148 can be used which, in one embodiment, is controlled by a pneumatic regulator 145. In at least one possible embodiment of the present application, the pneumatic regulator 145 is controlled by a pneumatic controller 147 on the control panel 149 of the cartoner assembly 100. In at least one possible embodiment, the vibration unit 148 assists the folded cartons 104 as they travel down the guide rods 107*a-d* by vibrating the guide rods 107*a-d* until the folded cartons 104 slide on the guide rods 107*a-d* as desired. The vibration unit 148, in at least one possible embodiment, could be controlled by an electric or hydraulic regulator. The control panel 149 is operatively connected to the belt drive motor 111 to permit a user to start and/or stop the belt drive motor 111.

Figure 5:
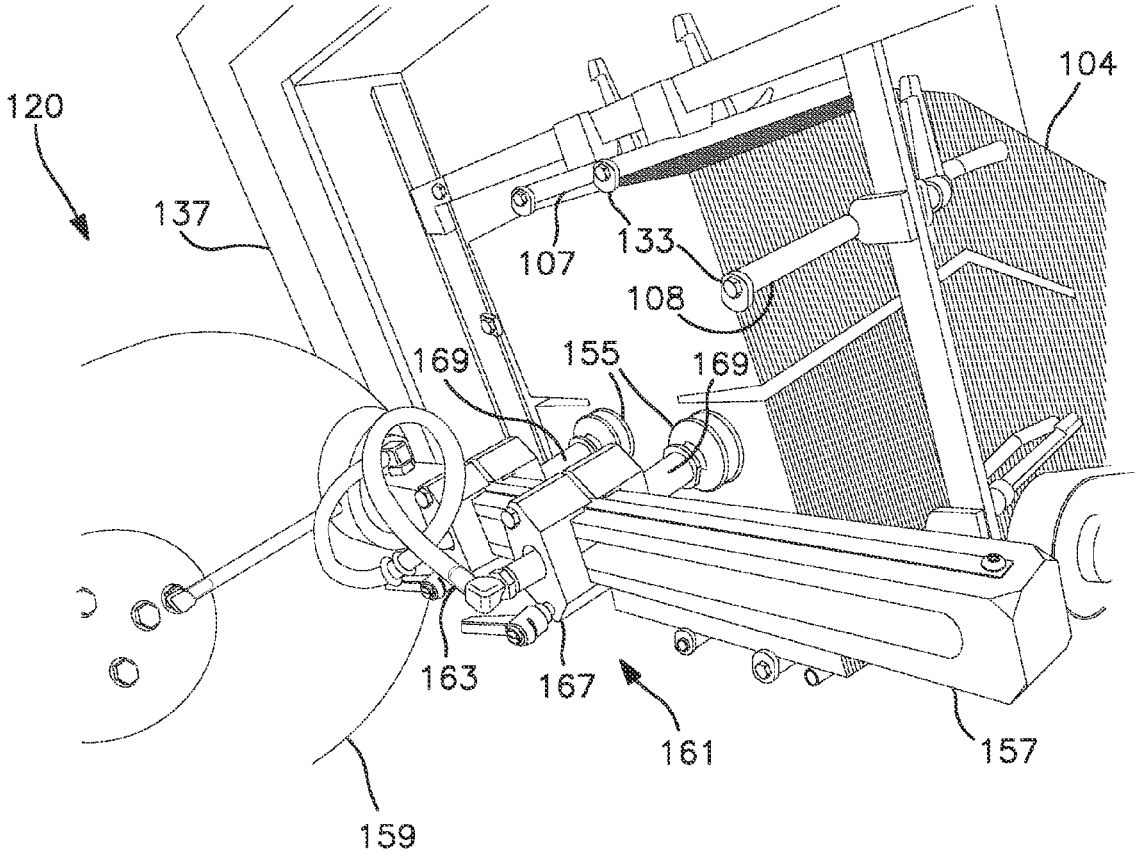
FIG. 5 shows a perspective view of a portion of the adjustable cartoner assembly according to FIG. 2.

Referring to FIG. 5, the folded cartons 104 are transported out of the adjustable magazine face plate 103 by means of a rotary feeder apparatus 120. The rotary feeder apparatus 120 is attached to the cartoner frame 181 by a support structure 171, as seen in FIG. 2, and includes an oval-shaped rotary plate 159 that is rotated about a center axis by a drive mechanism (not shown). Two arms or projecting bars 157 are mounted on opposite ends of the rotary plate 159 and project out substantially perpendicularly from the face of the rotary plate 159. It should be noted that in at least one possible embodiment, three or four arms or projecting bars 157 could be mounted on the rotary plate 159, which plate 159 could also be circular or elliptical in shape. Each of the arms or bars 157 is individually rotated about a center axis in a direction opposite the direction of rotation of the rotary plate 159 by a drive mechanism (not shown). For example, if the rotary plate 159 is rotating about its axis in a clockwise direction, the arms 157 individually rotate simultaneously about their axes in a counterclockwise direction.

On each of the arms 157 is mounted a carton retrieval arrangement 161 that grabs the folded cartons 104 and places the folded cartons 104 on the lower conveyor belt 117 (as seen in FIG. 2). The projecting bar 157 penetrates or passes through a holding structure 167 of the carton retrieval arrangement 161. A pair of shafts 169 pass through and project outwardly from the holding structure 167. On the ends of the shafts 169, there are vacuum suction cups 155 that are used to contact and remove the folded cartons 104 from the face plate 103. The vacuum cups 155 are connected to a vacuum source (not shown) by the shafts 169 and a hose arrangement 163. The vacuum source creates sufficient suction inside the hose arrangement 163 and shafts 169 to permit the vacuum cups 155 to overcome the retaining force of the stop tabs 133 and remove the folded cartons 104 from the face plate 103. The vacuum cups 155, which are rotating as part of the carton retrieval arrangement 161, release and place the folded cartons 104 on the lower conveyor belt 117 (as seen in FIG. 2) for further transportation.

Referring to FIG. 2, the rotary feeder apparatus 120 transports the folded cartons 104 out of the face plate 103 via vacuum cups 155. When the folded cartons 104 approach the lower conveyor belt 117, the folded cartons 104 are opened up between a pair of set up cams or projecting panels or frames 165 that are attached to or move with the lower conveyor belt 117. The set up cams 165 are a series of projecting members on or adjacent the lower conveyor belt 117 that are spaced apart to receive and hold an opened carton there between. As the rotary feeder apparatus 120 brings the folded cartons 104 downwards from the face plate 103 in a swinging motion, the force generated by the rotating arm 157 moving forward in a substantially downward direction and the impact of the folded carton 104 with the set up cams 165, continuously moving forward on the lower conveyor belt 117, forces the folded cartons 104 to open. In addition, the same force that causes the folded cartons 104 to open also overcomes the suction of the vacuum cups 155 on the rotary feeder apparatus 120 and the open carton is released from the vacuum cups 155 between the set up cams 165. The open cartons located between the set up cams 165 are then transported forward on the lower conveyor belt 117 for future packing.

In operation, the cartoner assembly 100 receives a supply of folded cartons 104 in the carton supply 102 on the guide conveyor 115. The motorized belt 101 of the guide conveyor 115 transports the folded cartons 104 forward into the face plate 103. While the face plate 103 holds a portion of the folded cartons 104, the remainder of the folded cartons 104 are located on the guide conveyor 115. The force generated by the motorized belt 101, as well as pressure from the weight of the folded cartons 104 in the carton supply 102 pushes the folded cartons 104 into the guide rods 107*a-d* on the face plate 103.

In one embodiment, the folded cartons 104 on the guide conveyor 115 are intermittently moved forward by the motorized belt 101. In this embodiment, the sensor 105*a* on the face plate 103 will sense a shortage of folded cartons 104 on the guide conveyor 115. When the sensor 105*a* detects a shortage of folded cartons 104 on the guide conveyor 115, the sensor 105*a* will signal the belt drive motor 111 to actuate the belt drive motor 111, and thus feed more folded cartons 104 via the motorized belt 101 into the face plate 103. When the folded cartons 104 slide into the guide rods 107*a-d* on the face plate 103, the folded cartons are held in place by the stop tabs 133 to be transported out of the face plate 103.

The rotary feeder apparatus 120 with vacuum cups 155 then grabs an individual folded carton 104 out of the stop tabs 133 of the face plate 103. To further explain, the rotary plate 159 rotates in a clockwise direction and the carton retrieval arrangements 161, located on the rotary plate 159, individually rotate simultaneously about their axes in a counterclockwise direction. When one of the carton retrieval arrangements 161 reach the folded cartons 104 in the stop tabs 133, the vacuum cups 155 grab the folded carton 104 and rotate the folded carton counterclockwise with the arm 157. When the carton retrieval arrangement 161 swings the folded carton 104 in a substantially downward direction during this counterclockwise rotation, the folded carton 104 comes in direct contact with the set up cam 165 on the moving lower conveyor belt 117. The force generated by the swinging motion of the rotary feeder apparatus 120, in addition to the connection of the folded carton 104 with the set up cam 165, forces the folded carton 104 to open and the vacuum cups 155 to release the now open carton. The now open carton is positioned between a pair of set up cams 165 on the lower conveyor belt 117 and is transported forward on the lower conveyor belt 117 for future packing.

The components disclosed in the various publications, disclosed or incorporated by reference herein, may possibly be used in possible embodiments of the present invention, as well as equivalents thereof.

One feature or aspect of an embodiment is believed at the time of the filing of this patent application to possibly reside broadly in a method for increasing production of cardboard cartons to increase production of runs of multiple limited batches of cartons by reducing time for adjusting a cartoner from a run of a first box size to a run of another box size to a run of yet another box size; said cartoner comprising: a cartoner frame; an input to receive flat, folded cartons; a conveyor operatively connected to said frame; said conveyor comprising: a conveyor belt to move flat, folded cartons from said input; and a motor connected to said conveyor belt to drive said conveyor belt; an adjustable face plate to receive flat, folded cartons from said conveyor belt; said adjustable face plate comprising: a face plate frame connected to said cartoner frame; said face plate frame comprising mounting panels; guide rods to guide flat, folded cartons from said conveyor belt through said face plate frame and to retain flat, folded cartons in said adjustable face plate; guide rod mounts to connect said guide rods to said mounting panels of said face plate frame; and said guide rod mounts comprising adjustable holding mechanisms to permit movement of said guide rod mounts within said frame to permit adjustment of the height and width spacing between said guide rod mounts, and thus the height and width spacing between said guide rods, to permit handling of numerous flat, folded carton sizes of different heights and widths; a set up conveyor belt to receive partially-open flat, folded cartons and open them fully; a rotary feeder apparatus to remove flat, folded cartons retained by said guide rods from said adjustable face plate and to initiate opening of flat, folded cartons and to feed partially-open flat, folded cartons to said set up conveyor belt; and said rotary feeder apparatus comprising vacuum cups to contact and remove flat, folded cartons from said adjustable face plate and hold flat, folded cartons during transport to said set up conveyor belt; said guide rod mounts comprise a top guide rod mount and a bottom guide rod mount disposed opposite and parallel to one another; said guide rod mounts comprise left and right side guide rod mounts disposed opposite and parallel to one another, and perpendicular to said top and bottom guide rod mounts; said adjustable face plate comprises a first threaded adjustment screw and a second threaded adjustment screw disposed adjacent and substantially parallel to said left side guide rod mount; said adjustable holding mechanism of each of said top guide rod mount and said bottom guide rod mount comprising a threaded opening; said first threaded adjustment screw is engaged with and passes through said threaded opening in said adjustable holding mechanism of said top guide rod mount; said first threaded adjustment screw is configured to be rotated to move said adjustable holding mechanism of said top guide rod mount up and down to adjust the vertical spacing between said top guide rod mount and said bottom guide rod mount; said second threaded adjustment screw is engaged with and passes through said threaded opening in said adjustable holding mechanism of said bottom guide rod mount; and said second threaded adjustment screw is configured to be rotated to move said adjustable holding mechanism of said bottom guide rod mount up and down to adjust the vertical spacing between said top guide rod mount and said bottom guide rod mount; each of said guide rods comprises a first end disposed adjacent said conveyor belt and a second end disposed opposite said first end; each of said guide rods comprises a stop tab disposed on said second end of said guide rod; each of said stop tabs is disposed to overlap and retain flat, folded cartons in said adjustable face plate; each of said stop tabs comprises locking elements to permit loosening, rotation, and locking of said stop tabs to permit an increase or decrease of overlap with flat, folded cartons, said method comprising the steps of: making a first run by opening 300 to 1500 flat, folded cartons, said step of making a first run comprising the steps of: moving said adjustable holding mechanism of at least one of said guide rod mounts and adjusting the height and width spacing between said guide rod mounts, and thus the height and width spacing between said guide rods on said guide rod mounts, sufficient to conform to and guide a first size of flat, folded cartons, said step of moving said adjustable holding mechanism of at least one of said guide rod mounts comprising at least one of: rotating said first threaded adjustment screw to move said adjustable holding mechanism of said top guide rod mount up or down; rotating said second threaded adjustment screw to move said adjustable holding mechanism of said bottom guide rod mount up or down; manually moving said adjustable holding mechanism of said left side guide rod mount; and manually moving said adjustable holding mechanism of said right side guide rod mount; adjusting said stop tabs to provide a predetermined overlap on said first size of flat, folded cartons by loosening said locking elements and rotating said stop tabs to said predetermined position relating to said first size of said flat, folded cartons; starting said cartoner machine; moving said flat, folded cartons on said conveyor belt to said face plate; guiding, with said guide rods, said flat, folded cartons into said face plate; retaining said flat, folded cartons with said stop tabs in said face plate; removing said flat, folded cartons from said guide rods with said vacuum cups on said rotary feeder apparatus; rotating and moving said flat, folded cartons with said rotary feeder apparatus and initiating opening of said flat, folded cartons; releasing said partially-open cartons onto said set up conveyor belt and substantially simultaneously continuing opening said flat, folded cartons on said set up conveyor belt; and stopping opening of further cartons by said cartoner machine and thus finishing said first run; making a second run, subsequent to said first run, by opening 300 to 1500 flat, folded cartons, said step of making a second run comprising the steps of: moving said adjustable holding mechanism of at least one of said guide rod mounts and adjusting the height and width spacing between said guide rod mounts, and thus the height and width spacing between said guide rods on said guide rod mounts, sufficient to conform to and guide a second size of flat, folded cartons, said step of moving said adjustable holding mechanism of at least one of said guide rod mounts comprising at least one of: rotating said first threaded adjustment screw to move said adjustable holding mechanism of said top guide rod mount up or down; rotating said second threaded adjustment screw to move said adjustable holding mechanism of said bottom guide rod mount up or down; manually moving said adjustable holding mechanism of said left side guide rod mount; and manually moving said adjustable holding mechanism of said right side guide rod mount; adjusting said stop tabs to provide a predetermined overlap on said second size of flat, folded cartons by loosening said locking elements and rotating said stop tabs to said predetermined position relating to said second size of said flat, folded cartons; starting said cartoner machine; moving said flat, folded cartons on said conveyor belt to said face plate; guiding, with said guide rods, said flat, folded cartons into said face plate; retaining said flat, folded cartons with said stop tabs in said face plate; removing said flat, folded cartons from said guide rods with said vacuum cups on said rotary feeder apparatus; rotating and moving said flat, folded cartons with said rotary feeder apparatus and initiating opening of said flat, folded cartons; releasing said partially-open cartons onto said set up conveyor belt and substantially simultaneously continuing opening said flat, folded cartons on said set up conveyor belt; and stopping opening of further cartons by said cartoner machine and thus finishing said second run; making a third run, subsequent to said second run, by opening 300 to 1500 flat, folded cartons, said step of making a third run comprising the steps of: moving said adjustable holding mechanism of at least one of said guide rod mounts and adjusting the height and width spacing between said guide rod mounts, and thus the height and width spacing between said guide rods on said guide rod mounts, sufficient to conform to and guide a third size of flat, folded cartons, said step of moving said adjustable holding mechanism of at least one of said guide rod mounts comprising at least one of: rotating said first threaded adjustment screw to move said adjustable holding mechanism of said top guide rod mount up or down; rotating said second threaded adjustment screw to move said adjustable holding mechanism of said bottom guide rod mount up or down; manually moving said adjustable holding mechanism of said left side guide rod mount; and manually moving said adjustable holding mechanism of said right side guide rod mount; adjusting said stop tabs to provide a predetermined overlap on said third size of flat, folded cartons by loosening said locking elements and rotating said stop tabs to said predetermined position relating to said third size of said flat, folded cartons; starting said cartoner machine; moving said flat, folded cartons on said conveyor belt to said face plate; guiding, with said guide rods, said flat, folded cartons into said face plate; retaining said flat, folded cartons with said stop tabs in said face plate; removing said flat, folded cartons from said guide rods with said vacuum cups on said rotary feeder apparatus; rotating and moving said flat, folded cartons with said rotary feeder apparatus and initiating opening of said flat, folded cartons; releasing said partially-open cartons onto said set up conveyor belt and substantially simultaneously continuing opening said flat, folded cartons on said set up conveyor belt; and stopping opening of further cartons by said cartoner machine and thus finishing said third run.

Another feature or aspect of an embodiment is believed at the time of the filing of this patent application to possibly reside broadly in the method, wherein: each of said guide rod mounts comprises guide locks to lock said guide rods thereon; and each of said guide locks is configured to be released to permit manual adjustment of the position of its corresponding guide rod on its corresponding guide rod mount sufficient to conform to a size of flat, folded cartons, and then relocked to hold its corresponding guide rod in its new position, said method further comprises the steps of: releasing at least one of said guide locks; manually moving and adjusting the position of at least one of said guide rods on its corresponding guide rod mount sufficient to conform to a size of flat, folded cartons; and relocking said at least one of said guide locks to hold its corresponding guide rod in its new position.

Yet another feature or aspect of an embodiment is believed at the time of the filing of this patent application to possibly reside broadly in the method, wherein said mounting panels comprise: a top mounting panel disposed adjacent said top guide rod mount; a bottom mounting panel disposed opposite and parallel to said top mounting panel and adjacent said bottom guide rod mount; a left mounting panel disposed adjacent said left side guide rod mount, and perpendicular to said top and bottom mounting panels; a right mounting panel disposed opposite and parallel to said left mounting panel and adjacent said right guide rod mount, and perpendicular to said top and bottom mounting panels; said left mounting panel comprises a scale; each of said adjustable holding mechanisms comprises a pointer; and each of said adjustable holding mechanisms is configured to be positioned by aligning said pointer with a point on said scale which corresponds to a position of said guide rod mount sufficient to conform to a carton size to be handled by said cartoner, and wherein: said step of rotating said first threaded adjustment screw to move said adjustable holding mechanism of said top guide rod mount up or down comprises moving said adjustable holding mechanism and aligning said pointer with a point on said scale which corresponds to a position of said top guide rod mount sufficient to conform to a carton size to be handled by said cartoner; and said step of rotating said second threaded adjustment screw to move said adjustable holding mechanism of said bottom guide rod mount up or down comprises moving said adjustable holding mechanism and aligning said pointer with a point on said scale which corresponds to a position of said bottom guide rod mount sufficient to conform to a carton size to be handled by said cartoner.

Still another feature or aspect of an embodiment is believed at the time of the filing of this patent application to possibly reside broadly in the method, wherein: each of said mounting panels comprises a slide rail; said adjustable holding mechanism of each of said guide rod mounts comprises two slide supports each disposed on opposite ends of said guide rod mount; said slide supports of each of said guide rod mounts are engaged with and slide on said slide rails to permit adjustment of the height and width spacing between said guide rod mounts; said slide supports of each of said left and right side guide rod mounts comprise an upper slide support engaged with said slide rail of said top mounting panel and a lower slide support engaged with said slide rail of said bottom mounting panel; said top mounting panel comprises a scale; each of said upper slide supports of said left and right side guide rod mounts comprises a pointer; each of said upper slide supports is configured to be positioned by aligning said pointer with a point on said scale of said top mounting panel which corresponds to a position of said guide rod mount sufficient to conform to a carton size to be handled by said cartoner; and at least one of said guide rod mounts comprises a guide rod scale and said guide locks thereon comprise a marking, wherein each of said guide rods is configured to be positioned by aligning said marking on said guide locks with a point on said guide rod scale which corresponds to a position of said guide rods sufficient to conform to a carton size to be handled by said cartoner, and wherein: said step of manually moving said adjustable holding mechanism of said left side guide rod mount comprises sliding said slide support and aligning said pointer with a point on said scale on said top mounting panel which corresponds to a position of said left side guide rod mount sufficient to conform to a carton size to be handled by said cartoner; said step of manually moving said adjustable holding mechanism of said right side guide rod mount comprises sliding said slide support and aligning said pointer with a point on said scale on said top mounting panel which corresponds to a position of said right side guide rod mount sufficient to conform to a carton size to be handled by said cartoner; and said step of manually moving and adjusting the position of at least one of said guide rods on its corresponding guide rod mount comprises aligning said marking on said guide locks with a point on said guide rod scale which corresponds to a position of said guide rods sufficient to conform to a carton size to be handled by said cartoner.

A further feature or aspect of an embodiment is believed at the time of the filing of this patent application to possibly reside broadly in a method for increasing production of cardboard cartons to increase production of runs of multiple limited batches of cartons by reducing time for adjusting a cartoner from a run of a first box size to a run of another box size to a run of yet another box size; said cartoner comprising: a cartoner frame; an input to receive flat, folded cartons; a conveyor operatively connected to said frame; said conveyor comprising: a conveyor belt to move flat, folded cartons from said input; and a motor connected to said conveyor belt to drive said conveyor belt; an adjustable face plate to receive flat, folded cartons from said conveyor belt; said adjustable face plate comprising: a face plate frame connected to said cartoner frame; said face plate frame comprising mounting panels; guide rods to guide flat, folded cartons from said conveyor belt through said face plate frame and to retain flat, folded cartons in said adjustable face plate; guide rod mounts to connect said guide rods to said mounting panels of said face plate frame; and said guide rod mounts comprising adjustable holding mechanisms to permit movement of said guide rod mounts within said frame to permit adjustment of the height and width spacing between said guide rod mounts, and thus the height and width spacing between said guide rods, to permit handling of numerous flat, folded carton sizes of different heights and widths; a set up conveyor belt to receive partially-open flat, folded cartons and open them fully; a rotary feeder apparatus to remove flat, folded cartons retained by said guide rods from said adjustable face plate and to initiate opening of flat, folded cartons and to feed partially-open flat, folded cartons to said set up conveyor belt; and said rotary feeder apparatus comprising vacuum cups to contact and remove flat, folded cartons from said adjustable face plate and hold flat, folded cartons during transport to said set up conveyor belt, said method comprising the steps of: making a first run by opening a first, limited number of flat, folded cartons, said step of making a first run comprising the steps of: moving said adjustable holding mechanism of at least one of said guide rod mounts and adjusting the height and width spacing between said guide rod mounts, and thus the height and width spacing between said guide rods on said guide rod mounts, sufficient to conform to and guide a first size of flat, folded cartons; starting said cartoner machine; moving said flat, folded cartons on said conveyor belt to said face plate; guiding, with said guide rods, said flat, folded cartons into said face plate; retaining said flat, folded cartons with said guide rods in said face plate; removing said flat, folded cartons from said guide rods with said vacuum cups on said rotary feeder apparatus; rotating and moving said flat, folded cartons with said rotary feeder apparatus and initiating opening of said flat, folded cartons; releasing said partially-open cartons onto said set up conveyor belt and substantially simultaneously continuing opening said flat, folded cartons on said set up conveyor belt; and stopping opening of further cartons by said cartoner machine and thus finishing said first run; making a second run, subsequent to said first run, by opening a second, limited number of flat, folded cartons, said step of making a second run comprising the steps of: moving said adjustable holding mechanism of at least one of said guide rod mounts and adjusting the height and width spacing between said guide rod mounts, and thus the height and width spacing between said guide rods on said guide rod mounts, sufficient to conform to and guide a second size of flat, folded cartons; starting said cartoner machine; moving said flat, folded cartons on said conveyor belt to said face plate; guiding, with said guide rods, said flat, folded cartons into said face plate; retaining said flat, folded cartons with said guide rods in said face plate; removing said flat, folded cartons from said guide rods with said vacuum cups on said rotary feeder apparatus; rotating and moving said flat, folded cartons with said rotary feeder apparatus and initiating opening of said flat, folded cartons; releasing said partially-open cartons onto said set up conveyor belt and substantially simultaneously continuing opening said flat, folded cartons on said set up conveyor belt; and stopping opening of further cartons by said cartoner machine and thus finishing said second run; making a third run, subsequent to said second run, by opening a third, limited number of flat, folded cartons, said step of making a third run comprising the steps of: moving said adjustable holding mechanism of at least one of said guide rod mounts and adjusting the height and width spacing between said guide rod mounts, and thus the height and width spacing between said guide rods on said guide rod mounts, sufficient to conform to and guide a third size of flat, folded cartons; starting said cartoner machine; moving said flat, folded cartons on said conveyor belt to said face plate; guiding, with said guide rods, said flat, folded cartons into said face plate; retaining said flat, folded cartons with said guide rods in said face plate; removing said flat, folded cartons from said guide rods with said vacuum cups on said rotary feeder apparatus; rotating and moving said flat, folded cartons with said rotary feeder apparatus and initiating opening of said flat, folded cartons; releasing said partially-open cartons onto said set up conveyor belt and substantially simultaneously continuing opening said flat, folded cartons on said set up conveyor belt; and stopping opening of further cartons by said cartoner machine and thus finishing said third run.

Another feature or aspect of an embodiment is believed at the time of the filing of this patent application to possibly reside broadly in a cartoner comprising: a cartoner frame; an input to receive flat, folded cartons; a conveyor operatively connected to said frame; said conveyor comprising: a conveyor belt to move flat, folded cartons from said input; and a motor connected to said conveyor belt to drive said conveyor belt; an adjustable face plate to receive flat, folded cartons from said conveyor belt; said adjustable face plate comprising: a face plate frame connected to said cartoner frame; said face plate frame comprising mounting panels; guide rods to guide flat, folded cartons from said conveyor belt through said face plate frame and to retain flat, folded cartons in said adjustable face plate; guide rod mounts to connect said guide rods to said mounting panels of said face plate frame; and said guide rod mounts comprising adjustable holding mechanisms to permit movement of said guide rod mounts within said frame to permit adjustment of the height and width spacing between said guide rod mounts, and thus the height and width spacing between said guide rods, to permit handling of numerous flat, folded carton sizes of different heights and widths; a set up conveyor belt to receive partially-open flat, folded cartons and open them fully; a rotary feeder apparatus to remove flat, folded cartons retained by said guide rods from said adjustable face plate and to initiate opening of flat, folded cartons and to feed partially-open flat, folded cartons to said set up conveyor belt; and said rotary feeder apparatus comprising vacuum cups to contact and remove flat, folded cartons from said adjustable face plate and hold flat, folded cartons during transport to said set up conveyor belt.

Yet another feature or aspect of an embodiment is believed at the time of the filing of this patent application to possibly reside broadly in the cartoner, wherein: said guide rod mounts comprise a top guide rod mount and a bottom guide rod mount disposed opposite and parallel to one another; said guide rod mounts comprise left and right side guide rod mounts disposed opposite and parallel to one another, and perpendicular to said top and bottom guide rod mounts; said adjustable face plate comprises a first threaded adjustment screw and a second threaded adjustment screw disposed adjacent and substantially parallel to said left side guide rod mount; said adjustable holding mechanism of each of said top guide rod mount and said bottom guide rod mount comprising a threaded opening; said first threaded adjustment screw is engaged with and passes through said threaded opening in said adjustable holding mechanism of said top guide rod mount; said first threaded adjustment screw is configured to be rotated to move said adjustable holding mechanism of said top guide rod mount up and down to adjust the vertical spacing between said top guide rod mount and said bottom guide rod mount; said second threaded adjustment screw is engaged with and passes through said threaded opening in said adjustable holding mechanism of said bottom guide rod mount; and said second threaded adjustment screw is configured to be rotated to move said adjustable holding mechanism of said bottom guide rod mount up and down to adjust the vertical spacing between said top guide rod mount and said bottom guide rod mount.

Still another feature or aspect of an embodiment is believed at the time of the filing of this patent application to possibly reside broadly in the cartoner, wherein: each of said guide rod mounts comprises guide locks to lock said guide rods thereon; and each of said guide locks is configured to be released to permit manual adjustment of the position of its corresponding guide rod on its corresponding guide rod mount sufficient to conform to a size of flat, folded cartons, and then relocked to hold its corresponding guide rod in its new position.

A further feature or aspect of an embodiment is believed at the time of the filing of this patent application to possibly reside broadly in the cartoner, wherein: each of said guide rods comprises a first end disposed adjacent said conveyor belt and a second end disposed opposite said first end; each of said guide rods comprises a stop tab disposed on said second end of said guide rod; each of said stop tabs is disposed to overlap and retain flat, folded cartons in said adjustable face plate; each of said stop tabs comprises locking elements to permit loosening, rotation, and locking of said stop tabs to permit an increase or decrease of overlap with flat, folded cartons.

Another feature or aspect of an embodiment is believed at the time of the filing of this patent application to possibly reside broadly in the cartoner, wherein said mounting panels comprise: a top mounting panel disposed adjacent said top guide rod mount; a bottom mounting panel disposed opposite and parallel to said top mounting panel and adjacent said bottom guide rod mount; a left mounting panel disposed adjacent said left side guide rod mount, and perpendicular to said top and bottom mounting panels; and a right mounting panel disposed opposite and parallel to said left mounting panel and adjacent said right guide rod mount, and perpendicular to said top and bottom mounting panels.

Yet another feature or aspect of an embodiment is believed at the time of the filing of this patent application to possibly reside broadly in the cartoner, wherein: said left mounting panel comprises a scale; each of said adjustable holding mechanisms comprises a pointer; and each of said adjustable holding mechanisms is configured to be positioned by aligning said pointer with a point on said scale which corresponds to a position of said guide rod mount sufficient to conform to a carton size to be handled by said cartoner.

Still another feature or aspect of an embodiment is believed at the time of the filing of this patent application to possibly reside broadly in the cartoner, wherein: each of said mounting panels comprises a slide rail; said adjustable holding mechanism of each of said guide rod mounts comprises two slide supports each disposed on opposite ends of said guide rod mount; and said slide supports of each of said guide rod mounts are engaged with and slide on said slide rails to permit adjustment of the height and width spacing between said guide rod mounts.

A further feature or aspect of an embodiment is believed at the time of the filing of this patent application to possibly reside broadly in the cartoner, wherein: said slide supports of each of said left and right side guide rod mounts comprise an upper slide support engaged with said slide rail of said top mounting panel and a lower slide support engaged with said slide rail of said bottom mounting panel; said top mounting panel comprises a scale; each of said upper slide supports of said left and right side guide rod mounts comprises a pointer; and each of said upper slide supports is configured to be positioned by aligning said pointer with a point on said scale of said top mounting panel which corresponds to a position of said guide rod mount sufficient to conform to a carton size to be handled by said cartoner.

Another feature or aspect of an embodiment is believed at the time of the filing of this patent application to possibly reside broadly in the cartoner, wherein at least one of said guide rod mounts comprises a guide rod scale and said guide locks thereon comprise a marking, wherein each of said guide rods is configured to be positioned by aligning said marking on said guide locks with a point on said guide rod scale which corresponds to a position of said guide rods sufficient to conform to a carton size to be handled by said cartoner.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

The appended drawings in their entirety, including all dimensions, proportions and/or shapes in at least one embodiment of the invention, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72 (b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

What is claimed is:

1. A method for increasing production of cardboard cartons to increase production of runs of multiple limited batches of cartons by reducing time for adjusting a cartoner from a run of a first carton size to a run of another carton size to a run of yet another carton size, said method comprising the steps of:

(A) adjusting at least one of: the height and width spacing between at least two of a plurality of adjustable guide rods of an adjustable face plate sufficient to substantially conform the height and width spacing between the guide rods to the height and width of a first size of flat, folded cartons;

adjusting stop tabs disposed at the ends of said guide rods disposed furthest from said conveyor to provide a predetermined overlap on flat, folded cartons of said first size by loosening locking elements of said stop tabs and rotating said stop tabs to a predetermined position relating to the size of said flat, folded cartons;

starting said cartoner machine;

moving a first, limited number of flat, folded cartons of said first size to said face plate;

guiding, with said guide rods, said flat, folded cartons of said first size on edge in said face plate;

retaining, with said stop tabs, said flat, folded cartons of said first size on said guide rods in said face plate;

removing said flat, folded cartons of said first size from said guide rods and said face plate;

rotating and moving said flat, folded cartons of said first size and initiating opening of said flat, folded cartons of said first size;

releasing said partially-open cartons of said first size and substantially simultaneously continuing opening said flat, folded cartons of said first size; and stopping said cartoner machine upon the first, limited number of flat, folded cartons of said first size being opened;

(B) adjusting at least one of: the height and width spacing between at least two of a plurality of adjustable guide rods of an adjustable face plate sufficient to substantially conform the height and width spacing between the guide rods to the height and width of a second size of flat, folded cartons, which second size is different from said first size;

adjusting stop tabs disposed at the ends of said guide rods disposed furthest from said conveyor to provide a predetermined overlap on flat, folded cartons of said second size by loosening locking elements of said stop tabs and rotating said stop tabs to a predetermined position relating to the size of said flat, folded cartons;

starting said cartoner machine;

moving a second, limited number of flat, folded cartons of said second size to said face plate;

guiding, with said guide rods, said flat, folded cartons of said second size on edge in said face plate;

retaining, with said stop tabs, said flat, folded cartons of said second size on said guide rods in said face plate;

removing said flat, folded cartons of said second size from said guide rods and said face plate;

rotating and moving said flat, folded cartons of said second size and initiating opening of said flat, folded cartons of said second size;

releasing said partially-open cartons of said second size and substantially simultaneously continuing opening said flat, folded cartons of said second size; and stopping said cartoner machine upon the second, limited number of flat, folded cartons of said second size being opened; and (C) adjusting at least one of: the height and width spacing between at least two of a plurality of adjustable guide rods of an adjustable face plate sufficient to substantially conform the height and width spacing between the guide rods to the height and width of a third size of flat, folded cartons, which third size is different from said second size;

adjusting stop tabs disposed at the ends of said guide rods disposed furthest from said conveyor to provide a predetermined overlap on flat, folded cartons of said third size by loosening locking elements of said stop tabs and rotating said stop tabs to a predetermined position relating to the size of said flat, folded cartons;

starting said cartoner machine;

moving a third, limited number of flat, folded cartons of said third size to said face plate;

guiding, with said guide rods, said flat, folded cartons of said third size on edge in said face plate;

retaining, with said stop tabs, said flat, folded cartons of said third size on said guide rods in said face plate;

removing said flat, folded cartons of said third size from said guide rods and said face plate;

rotating and moving said flat, folded cartons of said third size and initiating opening of said flat, folded cartons of said third size;

releasing said partially-open cartons of said third size and substantially simultaneously continuing opening said flat, folded cartons of said third size; and stopping said cartoner machine upon the third, limited number of flat, folded cartons of said third size being opened.

2. The method according to claim 1, wherein said step of adjusting said face plate in each of steps (A), (B), and (C) comprises adjusting both: the height spacing between at least two of the plurality of adjustable guide rods of an adjustable face plate, and the width spacing between at least two of the plurality of adjustable guide rods of an adjustable face plate.

3. The method according to claim 2, wherein said step of adjusting the height and width spacing between guide rods in each of steps (A), (B), and (C) comprises moving each one of a plurality of adjustable holding mechanisms to be moved, and thus moving a corresponding guide rod mount connected thereto, and thus moving at least one guide rod connected to the corresponding guide rod mount.

4. The method according to claim 3, wherein said step of moving said adjustable holding mechanism in each of steps (A), (B), and (C) comprises at least one of:

rotating a first threaded adjustment screw to move an adjustable holding mechanism of a top guide rod mount up or down;

rotating a second threaded adjustment screw to move an adjustable holding mechanism of a bottom guide rod mount up or down;

manually moving an adjustable holding mechanism of a left side guide rod mount; and manually moving an adjustable holding mechanism of a right side guide rod mount.

5. The method according to claim 4, wherein said step of moving a first, limited number of flat, folded cartons to said face plate in each of steps (A), (B), and (C) comprises moving the cartons on edge on a conveyor belt.

6. The method according to claim 5, wherein said steps of removing, rotating and moving, initiating opening, releasing, and substantially simultaneously continuing opening said flat, folded cartons in each of steps (A), (B), and (C) comprise:

removing said flat, folded cartons of said first size from said guide rods with vacuum cups on a rotary feeder apparatus;

rotating and moving said flat, folded cartons of said first size with said rotary feeder apparatus and initiating opening of said flat, folded cartons of said first size; and releasing said partially-open cartons of said first size onto a set up conveyor belt and substantially simultaneously continuing opening said flat, folded cartons of said first size on said set up conveyor belt.

7. The method according to claim 6, wherein said method further comprises the steps of:

releasing at least one of a plurality of guide locks, each being adjustably mounted on a corresponding guide rod mount and being configured to support a corresponding guide rod;

manually moving and adjusting the position of at least one of said guide rods on its corresponding guide rod mount sufficient to conform to a size of a flat, folded carton; and relocking said at least one of said guide locks to hold its corresponding guide rod in the new position on said guide rod mount.

8. The method according to claim 7, wherein:

said step of rotating said first threaded adjustment screw to move said adjustable holding mechanism of said top guide rod mount up or down comprises moving said adjustable holding mechanism and aligning a pointer with a point on a scale which corresponds to a position of said top guide rod mount sufficient to conform to a carton size to be handled by said cartoner; and said step of rotating said second threaded adjustment screw to move said adjustable holding mechanism of said bottom guide rod mount up or down comprises moving said adjustable holding mechanism and aligning a pointer with a point on a scale which corresponds to a position of said bottom guide rod mount sufficient to conform to a carton size to be handled by said cartoner.

9. The method according to claim 8, wherein:

said step of manually moving said adjustable holding mechanism of said left side guide rod mount comprises sliding a slide support and aligning a pointer with a point on a scale on a top mounting panel which corresponds to a position of said left side guide rod mount sufficient to conform to a carton size to be handled by said cartoner;

said step of manually moving said adjustable holding mechanism of said right side guide rod mount comprises sliding a slide support and aligning a pointer with a point on a scale on a top mounting panel which corresponds to a position of said right side guide rod mount sufficient to conform to a carton size to be handled by said cartoner;

said step of manually moving and adjusting the position of at least one of said guide rods on its corresponding guide rod mount comprises aligning said marking on said guide locks with a point on said guide rod scale which corresponds to a position of said guide rods sufficient to conform to a carton size to be handled by said cartoner; and said cartons comprise cardboard boxes.

10. A cartoner arrangement for performing the method according to claim 1, said cartoner arrangement comprising:

an adjusting arrangement being configured to adjust at least one of: the height and width spacing between at least two of a plurality of adjustable guide rods of an adjustable face plate sufficient to substantially conform the height and width spacing between the guide rods to the height and width of said first size of flat, folded cartons, said second size of flat folded cartons, and said third size of flat folded cartons;

a starting arrangement being configured to start said cartoner machine;

a moving arrangement being configured to move a first, limited number of flat, folded cartons of said first size to said face plate, a second, limited number of flat, folded cartons of said second size to said face plate, and a third, limited number of flat, folded cartons of said third size to said face plate;

guide rods being configured to guide flat, folded cartons of said first size, said second size, and said third size on edge in said face plate;

stop tabs being disposed at the ends of said guide rods disposed furthest from said conveyor, and being configured to provide a predetermined overlap on flat, folded cartons to retain flat, folded cartons of said first size, said second size, and said third size on said guide rods in said face plate;

said stop tabs being configured to be adjusted to provide a predetermined overlap on flat, folded cartons by loosening locking elements of said stop tabs and rotating said stop tabs to a predetermined position relating to the size of said flat, folded cartons;

a removing arrangement being configured to:

remove flat, folded cartons of said first size, said second size, and said third size from said guide rods and said face plate;

rotate and move flat, folded cartons of said first size, said second size, and said third size;

initiate opening of flat, folded cartons of said first size, said second size, and said third size; and release partially-open cartons of said first size, said second size, and said third size and substantially simultaneously continue opening said flat, folded cartons of said first size, said second size, and said third size; and a stopping arrangement being configured to stop said cartoner machine upon a first, limited number of flat, folded cartons of said first size being opened, a second, limited number of flat, folded cartons of said second size being opened, and a third, limited number of flat, folded cartons of said third size being opened.

11. A cartoner arrangement for increasing production of cardboard cartons to increase production of runs of multiple limited batches of cartons by reducing time for adjusting a cartoner from a run of a first carton size to a run of another carton size to a run of yet another carton size, said cartoner arrangement comprising:

an adjusting arrangement being configured to adjust at least one of: the height and width spacing between at least two of a plurality of adjustable guide rods of an adjustable face plate sufficient to substantially conform the height and width spacing between the guide rods to the height and width of a first size of flat, folded cartons, a second size of flat folded cartons different from said first size, and a third size of flat folded cartons different from said second size;

a starting arrangement being configured to start said cartoner machine;

a moving arrangement being configured to move a first, limited number of flat, folded cartons of said first size to said face plate, a second, limited number of flat, folded cartons of said second size to said face plate, and a third, limited number of flat, folded cartons of said third size to said face plate;

guide rods being configured to guide flat, folded cartons of said first size, said second size, and said third size on edge in said face plate;

each of said guide rods comprising a first end disposed adjacent said conveyor belt and a second end disposed opposite said first end;

each of said guide rods comprising a stop tab disposed on said second end of said guide rod;

each of said stop tabs being disposed to overlap and retain flat, folded cartons in said adjustable face plate;

each of said stop tabs comprising locking elements to permit loosening, rotation, and locking of said stop tabs to permit an increase or decrease of overlap with flat, folded cartons;

a removing arrangement being configured to:

remove flat, folded cartons of said first size, said second size, and said third size from said guide rods and said face plate;

rotate and move flat, folded cartons of said first size, said second size, and said third size;

initiate opening of flat, folded cartons of said first size, said second size, and said third size; and release partially-open cartons of said first size, said second size, and said third size and substantially simultaneously continue opening said flat, folded cartons of said first size, said second size, and said third size; and a stopping arrangement being configured to stop said cartoner machine upon a first, limited number of flat, folded cartons of said first size being opened, a second, limited number of flat, folded cartons of said second size being opened, and a third, limited number of flat, folded cartons of said third size being opened.

12. The cartoner arrangement according to claim 11, wherein:

said cartoner arrangement comprises a cartoner frame;

said moving arrangement comprises a conveyor operatively connected to said frame;

said conveyor comprises:

a conveyor belt to move flat, folded cartons; and a motor connected to said conveyor belt to drive said conveyor belt;

said adjustable face plate comprises a face plate frame connected to said cartoner frame;

said face plate frame comprises mounting panels;

said adjusting arrangement comprises:

guide rod mounts being movably connected to said mounting panels;

said guide rod mounts being configured and disposed to support said guide rods thereon; and adjustable holding mechanisms being connected to said guide rod mounts to permit movement of said guide rod mounts within said frame to permit adjustment of the height and width spacing between said guide rod mounts, and thus the height and width spacing between said guide rods;

said cartoner arrangement comprises a set up conveyor belt to receive partially-open flat, folded cartons and open them fully;

said removing arrangement comprises a rotary feeder apparatus to remove flat, folded cartons from said adjustable face plate and to initiate opening of flat, folded cartons and to feed partially-open flat, folded cartons to said set up conveyor belt; and said rotary feeder apparatus comprises vacuum cups to contact and remove flat, folded cartons from said adjustable face plate and hold flat, folded cartons during transport to said set up conveyor belt.

13. The cartoner arrangement according to claim 12, wherein:

said guide rod mounts comprise a top guide rod mount and a bottom guide rod mount disposed opposite and parallel to one another;

said guide rod mounts comprise left and right side guide rod mounts disposed opposite and parallel to one another, and perpendicular to said top and bottom guide rod mounts;

said adjustable face plate comprises a first threaded adjustment screw and a second threaded adjustment screw disposed adjacent and substantially parallel to said left side guide rod mount;

said adjustable holding mechanism of each of said top guide rod mount and said bottom guide rod mount comprises a threaded opening;

said first threaded adjustment screw is engaged with and passes through said threaded opening in said adjustable holding mechanism of said top guide rod mount;

said first threaded adjustment screw is configured to be rotated to move said adjustable holding mechanism of said top guide rod mount up and down to adjust the vertical spacing between said top guide rod mount and said bottom guide rod mount;

said second threaded adjustment screw is engaged with and passes through said threaded opening in said adjustable holding mechanism of said bottom guide rod mount; and said second threaded adjustment screw is configured to be rotated to move said adjustable holding mechanism of said bottom guide rod mount up and down to adjust the vertical spacing between said top guide rod mount and said bottom guide rod mount.

14. The cartoner arrangement according to claim 13, wherein:

each of said guide rod mounts comprises guide locks to lock said guide rods thereon; and each of said guide locks is configured to be released to permit manual adjustment of the position of its corresponding guide rod on its corresponding guide rod mount sufficient to conform to a size of flat, folded cartons, and then relocked to hold its corresponding guide rod in its new position.

15. The cartoner arrangement according to claim 14, wherein said mounting panels comprise:

a top mounting panel disposed adjacent said top guide rod mount;

a bottom mounting panel disposed opposite and parallel to said top mounting panel and adjacent said bottom guide rod mount;

a left mounting panel disposed adjacent said left side guide rod mount, and perpendicular to said top and bottom mounting panels; and a right mounting panel disposed opposite and parallel to said left mounting panel and adjacent said right guide rod mount, and perpendicular to said top and bottom mounting panels.

16. The cartoner arrangement according to claim 15, wherein:

said left mounting panel comprises a scale;

each of said adjustable holding mechanisms comprises a pointer; and each of said adjustable holding mechanisms is configured to be positioned by aligning said pointer with a point on said scale which corresponds to a position of said guide rod mount sufficient to conform to a carton size to be handled by said cartoner.

17. The cartoner arrangement according to claim 16, wherein:

each of said mounting panels comprises a slide rail;

said adjustable holding mechanism of each of said guide rod mounts comprises two slide supports each disposed on opposite ends of said guide rod mount; and said slide supports of each of said guide rod mounts are engaged with and slide on said slide rails to permit adjustment of the height and width spacing between said guide rod mounts.

18. The cartoner arrangement according to claim 17, wherein:

said cartoner arrangement is configured to handle cardboard boxes;

said slide supports of each of said left and right side guide rod mounts comprise an upper slide support engaged with said slide rail of said top mounting panel and a lower slide support engaged with said slide rail of said bottom mounting panel;

said top mounting panel comprises a scale;

each of said upper slide supports of said left and right side guide rod mounts comprises a pointer;

each of said upper slide supports is configured to be positioned by aligning said pointer with a point on said scale of said top mounting panel which corresponds to a position of said guide rod mount sufficient to conform to a carton size to be handled by said cartoner; and at least one of said guide rod mounts comprises a guide rod scale and said guide locks thereon comprise a marking, wherein each of said guide rods is configured to be positioned by aligning said marking on said guide locks with a point on said guide rod scale which corresponds to a position of said guide rods sufficient to conform to a carton size to be handled by said cartoner.

* * * * *